US006439945B1

(12) United States Patent
Liu

(10) Patent No.: US 6,439,945 B1
(45) Date of Patent: Aug. 27, 2002

(54) OCTOPUS-SHAPED BUILT-UP TOY

(76) Inventor: Kuo-Ching Liu, 5FL., No. 11 Alley 1, Lane1, Sec. 1, Yunhan S. Road, Lujou City, Paipei (TW)

( * ) Notice: Subject to any disclaimer, the term of this patent is extended or adjusted under 35 U.S.C. 154(b) by 0 days.

(21) Appl. No.: 09/951,974

(22) Filed: Sep. 14, 2001

(51) Int. Cl.[7] ..... A63M 33/00

(52) U.S. Cl. ..... 446/71; 273/160; 273/156; 446/97

(58) Field of Search ..... 446/71, 105–109, 446/119, 122, 124; 434/247, 259, 208, 277, 278, 279, 281, 211; 273/156, 157 R, 153 R

(56) References Cited

U.S. PATENT DOCUMENTS 3,577,660 A * 5/1971 Kenney
5,762,336 A * 6/1998 Miller, Jr. ..... 273/160
5,911,328 A * 6/1999 Shampo ..... 211/40

OTHER PUBLICATIONS www.home and office, see attached.*

* cited by examiner

*Primary Examiner*—Derris H. Banks
*Assistant Examiner*—Jamila Williams
(74) *Attorney, Agent, or Firm*—Troxell Law Office PLLC

(57) ABSTRACT

An octopus-shaped toy is built up from a plurality of modeled parts including two main body parts, two interconnecting parts, and a plurality of tentacle parts. All these modeled parts are connected to one another through engagement of slits provided thereon and thereby form a three-dimensional toy octopus. These parts are also provided with patterns showing specific features that are usually found on a real octopus, so that the assembled toy octopus is vivid to attract more players and helps players to know more things about the octopus.

3 Claims, 3 Drawing Sheets

OCTOPUS-SHAPED BUILT-UP TOY

FIELD OF THE INVENTION

The present invention relates to an octopus-shaped toy, and more particularly to an octopus-shaped toy built up from a plurality of modeled parts, so that a player learns more things about the octopus from assembling the modeled parts.

BACKGROUND OF THE INVENTION

The built-up toy is presently one of the most welcomed toys among children. It enables a player to enjoy the pleasure of assembling different parts into an embodied toy through thinking and imagination.

The currently available built-up toys are generally divided into two types, namely, modularized built-up toys and imitative built-up toys. A modularized built-up toy usually includes a plurality of modules that have a uniform shape, such as round, polygonal modules and the like. An imitative built-up toy usually has an appearance imitating or converted from a real thing in our life, such as some kind of animal or mechanical structure, and includes a plurality of modeled parts that representing different and distinct areas featuring the real thing being imitated.

The modules included in a modularized built-up toy could be freely assembled to one another completely through a player's creative ideas. The player may freely build up various kinds of predefined or imaginary figures from the uniform modules. However, from the standpoint of helping a player, particularly a child, to understand the structure of a real thing from assembling of the built-up toy, the imitative built-up toys would be a preferred choice.

In the production of conventional imitative built-up toys, the imitated items are usually roughly divided into only a few major parts. Therefore, the imitative toys built up from these parts do not present overall appearances and particulars as close as possible to the real things being imitated. That is, there is a considerable difference between the toys built up from the roughly divided parts and the real things being imitated. Thus, the assembled toys do not enable the players to have an idea about the exact three-dimensional configurations of the real things being imitated.

Moreover, the conventional built-up toys are usually made to a rather small scale to the real things. This condition and still many other factors prevent the imitative built-up toys from showing more detailed features of the real things to attract and educate players.

SUMMARY OF THE INVENTION

It is therefore a primary object of the present invention to provide an improved built-up toy that eliminates the drawbacks existing in the conventional imitative built-up toys so as to present a three-dimensional body and more distinct features of a real thing being imitated.

In an embodiment of the present invention, an octopus-shaped built-up toy is provided. The toy includes a plurality of modeled parts separately representing distinct areas of a real octopus and having patterns painted thereon to show features of the octopus. These modeled parts are connectable to one another through tight-fitting slits provided thereon, so that an attractive three-dimensional toy octopus is formed.

BRIEF DESCRIPTION OF THE DRAWINGS

The structure and the technical means adopted by the present invention to achieve the above and other objects can be best understood by referring to the following detailed description of the preferred embodiment and the accompanying drawings, wherein.

DETAILED DESCRIPTION OF THE PREFERRED EMBODIMENTS

Figure 1:
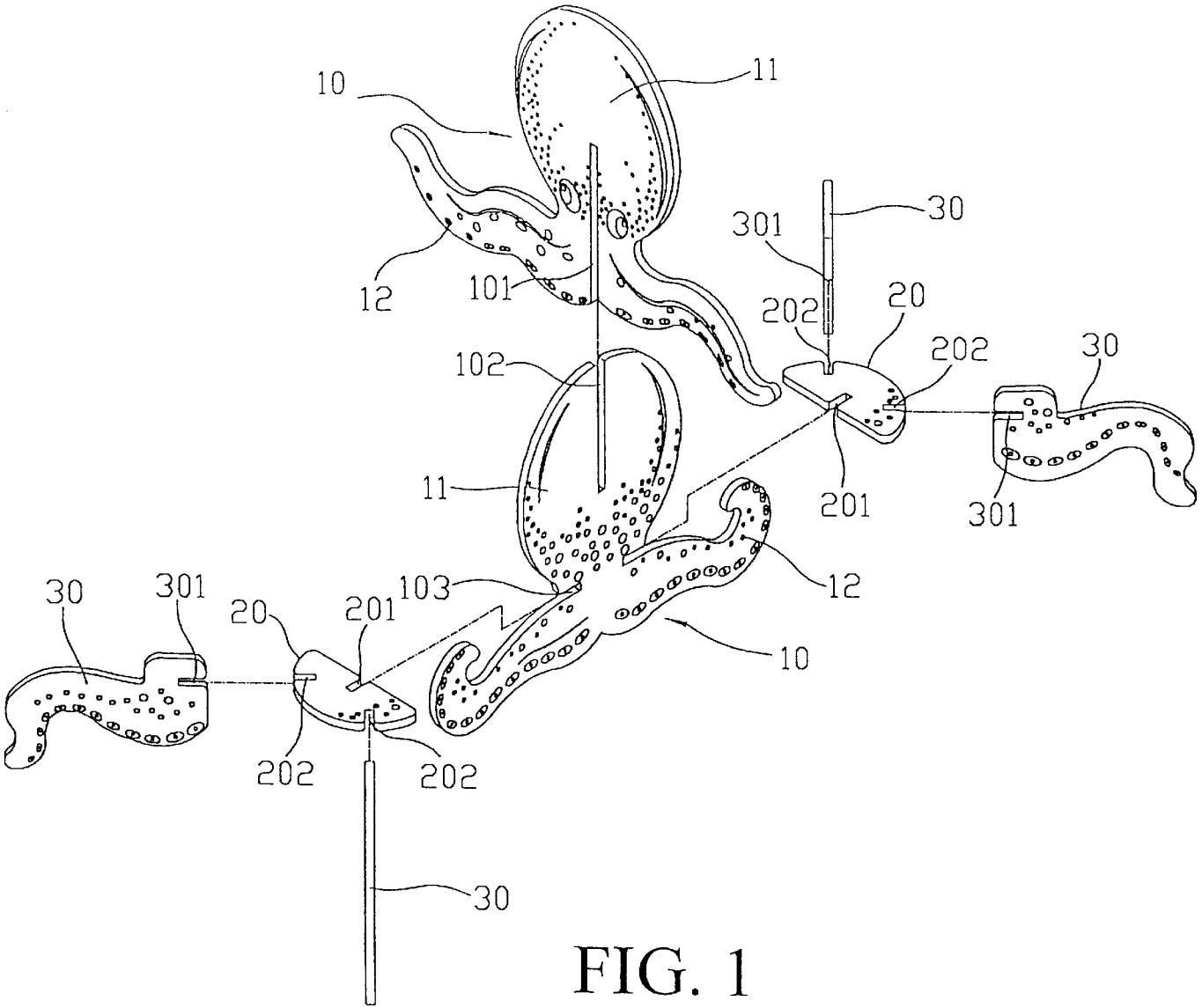
FIG. 1 is an exploded perspective view of an octopus-shaped built-up toy according to an embodiment of the present invention.

Please refer to FIG. 1 that is an exploded perspective view of an octopus-shaped built-up toy according to an embodiment of the present invention. As shown in FIG. 1, the octopus-shaped toy is built up from a plurality of modeled parts that generally represent some specific and featuring areas of an octopus. These modeled parts mainly include first and second main body parts 10, two interconnecting parts 20, and a plurality of tentacle parts 30.

Both the first and the second main body parts 10 include a head portion 11 and a plurality of tentacle portions 12 below the head portion 11. The first main body part 10 is provided at a lower end with a first slit 101, and the second main body part 10 is provided at an upper end with a second slit 102 and at two sides of a joint of the head portion 11 and the tentacle portions 12 with two opposite third slits 103.

Each of the two interconnecting parts 20 is provided at an inner edge facing toward the main body parts 10 with a fourth slit 201 for engaging with the third slit 103 on the second main body part 10, and at an outer edge facing away from the main body parts 10 with a plurality of equally spaced fifth slits 202.

Each of the tentacle parts 30 is provided at a predetermined position with a sixth slit 301 for engaging with one of the plurality of fifth slits 202 on the interconnecting part 20.

Figure 2:
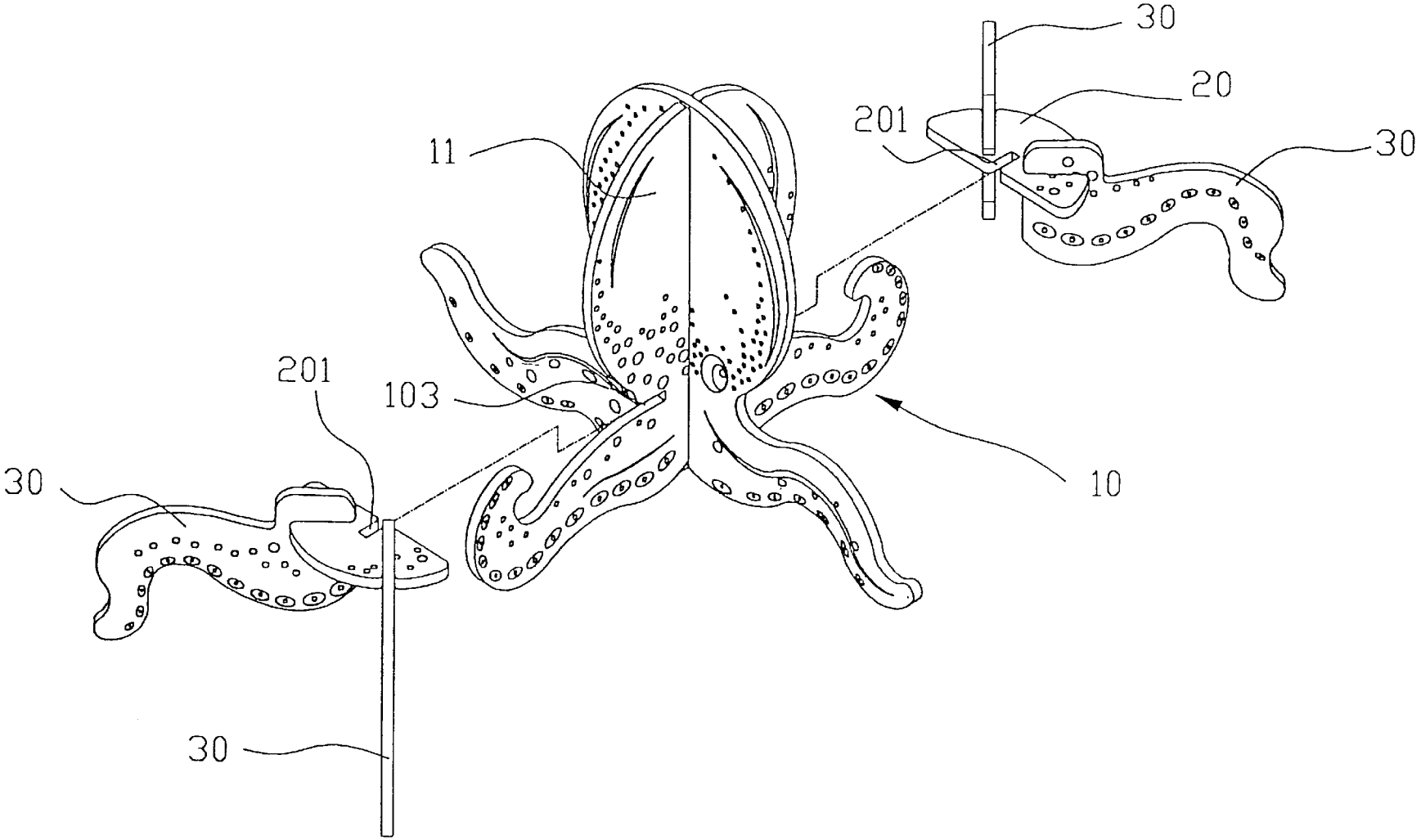
FIG. 2 is a partially assembled perspective view of the octopus-shaped built-up toy of FIG. 1.

With the above arrangements, it is possible to connect the main body parts 10, the interconnecting parts 20, and the tentacle parts 30 with one another through engagement of the first slit 101 with the second slit 102, the third slits 103 with the fourth slits 201, and the fifth slits 202 with the sixth slits 301, as shown in FIG. 2.

A player may connect the parts 10, 20 and 30 to one another step by step in accordance with the following instructions:

1. Align the first slit 101 on the first main body part 10 with the second slit 102 on the second main body part 10, such that the first and the second main body parts 10 perpendicularly intersect with each other at the two slits 101, 102 to form a three-dimensional head and a plurality of tentacles outward extended from the head.
2. Connect the two interconnecting parts 20 to the two associated main body parts 10 by engaging the fourth slits 301 at the inner edge of the interconnecting parts 20 with the two third slits 103 on the second main body part 10, so that the interconnecting parts 20 are horizontally located at two opposite sides of the second main body part 10.
3. Connect the tentacle parts 30 to the interconnecting parts 20 one by one through engagement of each sixth slit 301 with any one of the fifth slits 202 on the interconnecting parts 20, so that each tentacle part 30 extends from the outer edge of the interconnecting part 20 in a plane perpendicular to the latter, and together with the tentacle portions 12 of the two main body parts 10 form a plurality of tentacles below the octopus' head.

Figure 3:
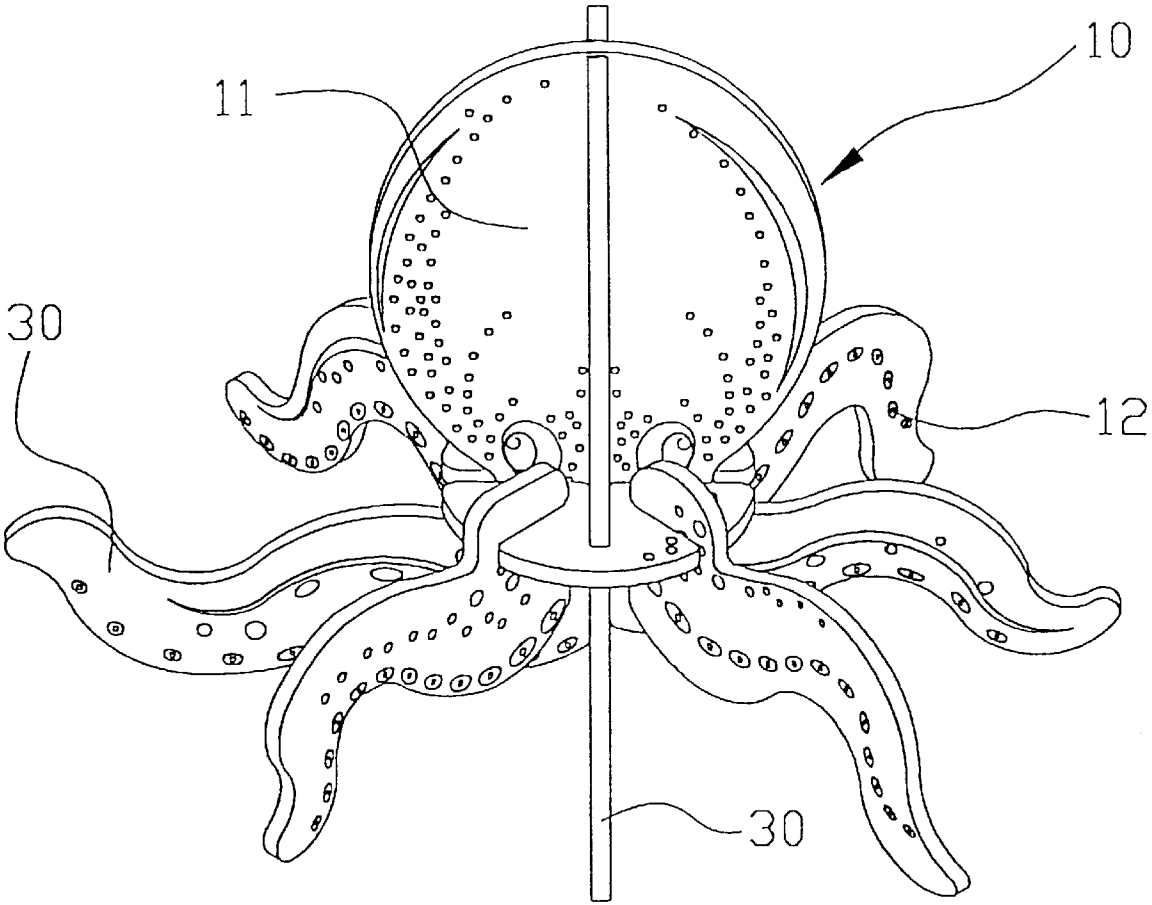
FIG. 3 is a fully assembled perspective view of the octopus-shaped built-up toy of FIG. 1.

The assembled modeled parts together form a three-dimensional octopus-shaped toy, as shown in FIG. 3. The modeled parts generally present a full configuration as well as many particular areas of the octopus. However, to present the octopus as real as possible, each of the modeled parts 10, 20 and 30 may be painted to show specific patterns that are usually found on the octopus.

Thus, the built-up toy of the present invention not only shows an overall appearance of the octopus, but also many detailed areas thereof for a player to know more things about the octopus.

Further, to enable firm connection of the main body parts 10, the interconnecting parts 20, and the tentacle parts 30 to avoid undesired separation of them from one another at the engaged slits, all the slits 101, 102, 103, 201, 202, and 301 are designed to engage with one another in a tight-fit relation. Moreover, to avoid the assembled octopus-shaped toy from a dull and monotonous appearance, the tentacle portions 12 on the main body parts 10 and each of the tentacle parts 30 may be differently designed, so that they together with the patterns painted thereon make the assembled toy a vivid octopus to attract the player.

The present invention has been described with a preferred embodiment thereof and it is understood that many changes and modifications in the described embodiment can be carried out without departing from the scope and the spirit of the invention that is intended to be limited only by the appended claims.

What is claimed is:

1. An octopus-shaped built-up toy comprising a plurality of modeled parts, said modeled parts including:

a first and a second main body part, both of which including a head portion and a plurality of tentacle portions below said head portion, said first main body part being provided at a lower end with a first slit, and said second main body part being provided at an upper end with a second slit adapted to engage with said first slit and at two sides of a joint of said head portion and said tentacle portions with two opposite third slits;

two interconnecting parts, each of which being provided at an edge with a fourth slit for engaging with said third slit on said second main body part, and at another edge with a plurality of equally spaced fifth slits; and a plurality of tentacle parts, each of which having a shape of an octopus' tentacle and being provided at a predetermined position with a sixth slit for engaging with any of said fifth slits on said interconnecting parts.

2. The octopus-shaped built-up toy as claimed in claim 1, wherein said first main body part, said second main body part, and said tentacle parts are provided with patterns showing particular features that are usually found on an octopus.

3. The octopus-shaped built-up toy as claimed in claim 1, wherein said fifth slits are provided at an outer edge of each said interconnecting part facing away from said second main body part.

* * * * *